US009484643B2

(12) United States Patent
Schaefer et al.

(10) Patent No.: US 9,484,643 B2
(45) Date of Patent: Nov. 1, 2016

(54) CONTACT ELEMENT FOR CONNECTING TO A CIRCUIT BOARD, CONTACT SYSTEM AND METHOD

(71) Applicant: Robert Bosch GmbH, Stuttgart (DE)

(72) Inventors: Rainer Schaefer, Asperg (DE); Thomas Wiesa, Vaihingen (DE); Christian Klein, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/411,551

(22) PCT Filed: Apr. 29, 2013

(86) PCT No.: PCT/EP2013/058883

§ 371 (c)(1),
(2) Date: Dec. 29, 2014

(87) PCT Pub. No.: WO2014/000920

PCT Pub. Date: Jan. 3, 2014

(65) Prior Publication Data

US 2015/0162669 A1 Jun. 11, 2015

(30) Foreign Application Priority Data

Jun. 27, 2012 (DE) ..... 10 2012 210 921

(51) Int. Cl.
*H01R 4/24* (2006.01)
*H01R 12/67* (2011.01)
*H01R 12/72* (2011.01)

(52) U.S. Cl.
CPC ..... *H01R 4/2404* (2013.01); *H01R 4/242* (2013.01); *H01R 12/675* (2013.01); *H01R 12/721* (2013.01)

(58) Field of Classification Search
CPC .. H01R 4/2404; H01R 4/242; H01R 12/675; H01R 12/721
USPC ..... 439/393, 426, 387, 435, 78, 81, 876, 439/444
See application file for complete search history.

(56) References Cited

U.S. PATENT DOCUMENTS 3,780,431 A * 12/1973 Feeney ..... H05K 3/0052 174/254
4,490,004 A * 12/1984 Lawrence ..... H01F 5/04 439/389

(Continued)

FOREIGN PATENT DOCUMENTS

DE 19921768 11/2000
DE 20008305 3/2001

(Continued)

OTHER PUBLICATIONS

International Search Report for Application No. PCT/EP2013/058883 dated Aug. 6, 2013 (English Translation, 2 pages).

*Primary Examiner* — Abdullah Riyami
*Assistant Examiner* — Nelson R Burgos-Guntin
(74) *Attorney, Agent, or Firm* — Michael Best & Friedrich LLP

(57) ABSTRACT

The invention relates to a contact element for connecting to a circuit board. The circuit board has at least one substrate layer, particularly an electrically insulating substrate layer. The circuit board also has at least one electrically conductive layer. The contact element is designed for connecting to the electrically conductive layer. According to the invention, the contact element is designed to be pushed onto a circuit board edge of the circuit board. The contact element is designed to reach over the circuit board edge and has at least one cutting blade with a cutting edge, the cutting edge having a harder metal in the area of a severing section than in an adjoining contact section alongside the cutting edge. The cutting edge is designed to cut through the substrate layer with the severing section when pushed onto the circuit board edge and to contact the electrically conductive layer electrically with the contact section.

18 Claims, 3 Drawing Sheets

(56) References Cited

U.S. PATENT DOCUMENTS 4,586,772 A * 5/1986 Cobaugh ..... H01R 12/89 439/325
5,073,119 A * 12/1991 Soes ..... H01R 12/585 439/751
6,616,819 B1 * 9/2003 Liamos ..... G01N 27/3272 204/403.02
8,232,818 B2 * 7/2012 Desta ..... G01R 1/07378 324/756.01
2008/0286990 A1 * 11/2008 Hiew ..... H01L 21/565 439/55
2009/0093136 A1 * 4/2009 Hiew ..... G06F 1/1632 439/55
2009/0203269 A1 * 8/2009 Jenne ..... G01D 11/245 439/862
2009/0305550 A1 * 12/2009 Suzuki ..... H01R 12/592 439/494
2010/0009567 A1 * 1/2010 Gyagang ..... H01R 4/2462 439/395
2010/0068916 A1 * 3/2010 Chen ..... H01R 13/41 439/391
2010/0136803 A1 * 6/2010 Nakamura ..... H05K 1/142 439/65
2010/0159727 A1 * 6/2010 Chang ..... H01R 4/027 439/294
2010/0302746 A1 * 12/2010 Wing ..... B29C 45/14639 361/760
2012/0088395 A1 * 4/2012 Feldner ..... H01R 4/2429 439/435
2013/0344732 A1 * 12/2013 Shin ..... H01R 13/60 439/534
2015/0099398 A1 * 4/2015 Benoliel ..... H01R 13/6683 439/630

FOREIGN PATENT DOCUMENTS

DE 102005005917 8/2006
DE WO 2014000920 A1 * 1/2014 ..... H01R 4/242
EP 0228723 7/1987
EP 239422 9/1987
EP 1122820 8/2001
GB 2235833 3/1991
GB 2360397 9/2001

* cited by examiner

CONTACT ELEMENT FOR CONNECTING TO A CIRCUIT BOARD, CONTACT SYSTEM AND METHOD

BACKGROUND OF THE INVENTION

The invention relates to a contact element for connecting to a circuit board. The circuit board has at least one substrate layer, particularly an electrically insulating substrate layer. The circuit board also has at least one electrically conductive layer, particularly an internal electrically conductive layer. The electrically conductive layer is preferably connected to the substrate layer. The contact element is designed for connecting to the electrically conductive layer.

In systems known from the prior art in which a contact element, which, for example, is connected to a terminal or a connecting wire, an electrically conductive inner layer of the circuit board is connected to a connecting element, for example a soldering pin or the like. The contact element can then be attached to the soldering pin in the form of a plug connector.

SUMMARY OF THE INVENTION

The invention is particularly characterized in that the contact element is designed to be pushed onto a circuit board edge of the circuit board. The contact element is preferably designed to reach over the circuit board edge. The contact element has at least one cutting blade with a cutting edge, the cutting edge having a harder metal in the area of a severing section than in an adjoining contact section alongside the cutting edge. The cutting edge is preferably designed to cut through the substrate layer with the severing section when pushed onto the circuit board edge and to contact the electrically conductive layer electrically with the contact section.

An electrically conductive inner layer of a circuit board can thus be advantageously contacted without exposing and thus laying bare the electrically conductive layer from the substrate at least on one surface area by, for example, milling or drilling.

The electrically conductive layer of the circuit board preferably forms an inner layer of the circuit board. The circuit board is preferably a multi-layered circuit board which, for example, has at least two electrically conductive layers and comprises—preferably in accordance with a sandwich construction—substrate layers which insulate the electrically conductive layers from one another and surround the same. The substrate layer is preferably an epoxy resin layer and furthermore preferably a fiber-reinforced, in particular fiberglass-reinforced epoxy resin layer.

The contact element can advantageously cut through the substrate layer by means of the cutting edge which is designed in the manner described above and contact the electrically conductive layer in the area of the circuit board edge with the contact section, which preferably has a better electrical conductivity than the severing section.

The contact element has preferably at least two cutting edges and is designed to reach over the circuit board edge and to contact the electrically conductive layers from two sides by means of the two cutting edges. The contact element has preferably two clamping jaws which are spaced apart from one another and jointly reach around an opening that extends longitudinally. The clamping jaws each have at least one cutting edge. The cutting edges preferably extend with the longitudinal extension thereof in the longitudinal direction of the opening. The blades of the cutting edges starting from the clamping jaws extend into the opening disposed between the clamping jaws.

In a preferred embodiment, the contact element has an opening which tapers towards one end and extends longitudinally, the cutting edge forming an opening edge of the opening.

A pressing effect can be achieved by means of the tapering and longitudinally extending opening; thus, when inserting the circuit board edge into the opening, enabling the previously mentioned clamping jaws to generate an increasing pressing force during insertion of the circuit board edge along the longitudinal extension of the opening.

In a preferred embodiment, the contact element is of U-shaped design, wherein the U-limbs are each formed by a clamping jaw. At least one of the clamping jaws of the U-shaped contact element has preferably at least one cutting edge. In a further preferable manner, both clamping jaws have at least one cutting edge.

The cutting edges are preferably designed in each case to extend linearly.

In a preferred embodiment, the at least one cutting edge runs circumferentially around a rotational axis so as to be spaced apart radially from the rotational axis. The contact element is preferably designed to cut into the circuit board edge by being rotationally moved about the rotational axis. The contact element is furthermore preferably designed to cut through the substrate layer with the severing section and to contact the electrically conductive layer electrically with the contact section.

The previously mentioned contact element comprising the cutting edge disposed circumferentially around the rotational axis is preferably cylindrical in design, wherein the rotational axis extends coaxially with respect to a longitudinal axis of the cylinder. The cylindrically designed contact element is at least in part designed in the shape of a hollow cylinder; thus enabling the circuit board edge to be at least in part accommodated in the hollow cylinder when the contact element is turned onto the circuit board edge.

In a preferred embodiment, the severing section of the cutting edge is designed to cut through fibers integrated into the substrate layer when pushed onto, or in the case of the cylindrical contact element: when turned onto, the circuit board edge. The fibers are, for example, glass fibers.

The material of the cutting edge preferably comprises steel or ceramics in the severing section and copper in the contact section. The contact section preferably consists at least in part of copper, preferably pure copper. Advantageous embodiments for the copper in the region of the contact section are copper alloys, for example an alloy of copper and tin, in particular CuSn4, CuSn6, or a copper alloy that complies with the US standard: Unified Numbering System (UNS) C18018. In another embodiment, the copper alloy comprises 0.8 to 1.8 percent nickel, 0.15 to 0.35 percent silicon and 0.01 percent phosphorus. The copper alloy is preferably an alloy that complies with the UNS-C-19010 standard.

The copper alloy preferably comprises an admixture consisting of chrome, silver, iron, titanium, silicon and for the most part copper.

The contents of the admixture are in each case preferably 0.5% chrome, 0.1% silver, 0.08% iron, 0.06% titanium and 0.03% silicon. An electrical conductivity of the contact section is preferably at least 30, preferably 46, megasiemens per meter.

The cutting edge preferably has a coating comprising tin, bismuth, silver, gold, lead or a combination thereof in the region of the contact section.

The invention also relates to a contact system comprising at least a contact element according to the type described above. The contact system comprises a circuit board having at least one substrate layer and at least one electrically conductive layer. The material of the cutting edge of the contact element is preferably designed harder in the area of the contact section than the material of the electrically conductive layer. The material of the electrically conductive layer of the circuit board is, for example, formed from a pure copper which is of softer design than the material of the cutting edge, in particular in the area of the contact section. The harder or, respectively, softer embodiment preferably relates to a Shore hardness and/or to a modulus of elasticity of the electrically conductive material.

As a result of the harder design of the cutting edge in the area of the contact section, a plastic deformation of the electrically conductive layer of the circuit board can preferably be achieved by the opening which tapers and extends longitudinally. In a further preferred manner, the contact element of the contact system is designed to produce a cold weld between the contact section of the cutting edge and the electrically conductive layer in the area of the circuit board edge when pushed onto or turned onto said circuit board edge.

A substrate layer to be severed by the cutting edge, in particular by a cutting edge of the cutting edges, has preferably a thickness that is between five percent and thirty percent of the thickness of the circuit board, further preferably of at least one tenth the thickness of the circuit board.

A thickness of the substrate layer to be severed is preferably at least 100 micrometers.

The electrically conductive layer can, for example, be produced by means of stamping prior to being laminated to the substrate layers. The electrically conductive layer has, for example, a layer thickness between 0.1 and 2 millimeters.

The invention also relates to a method for connecting a circuit board to a contact element.

The circuit board has at least one electrically conductive layer and at least one electrically insulating substrate layer connected to the electrically conductive layer. In the method, the substrate layer is severed—preferably by means of a severing section of a cutting blade—when pushing the contact element onto a circuit board edge of the circuit board; and the electrically conductive layer is electrically contacted—preferably by means of a contact section of the cutting blade—in the area of the severed substrate section.

The substrate layer preferably comprises fibers, in particular glass fibers, and is severed together with the fibers.

The invention is now described below with the aid of the drawings and further exemplary embodiments. Further advantageous embodiments ensue from the features of the dependent claims and the features of the drawings.

DETAILED DESCRIPTION

Figure 1:
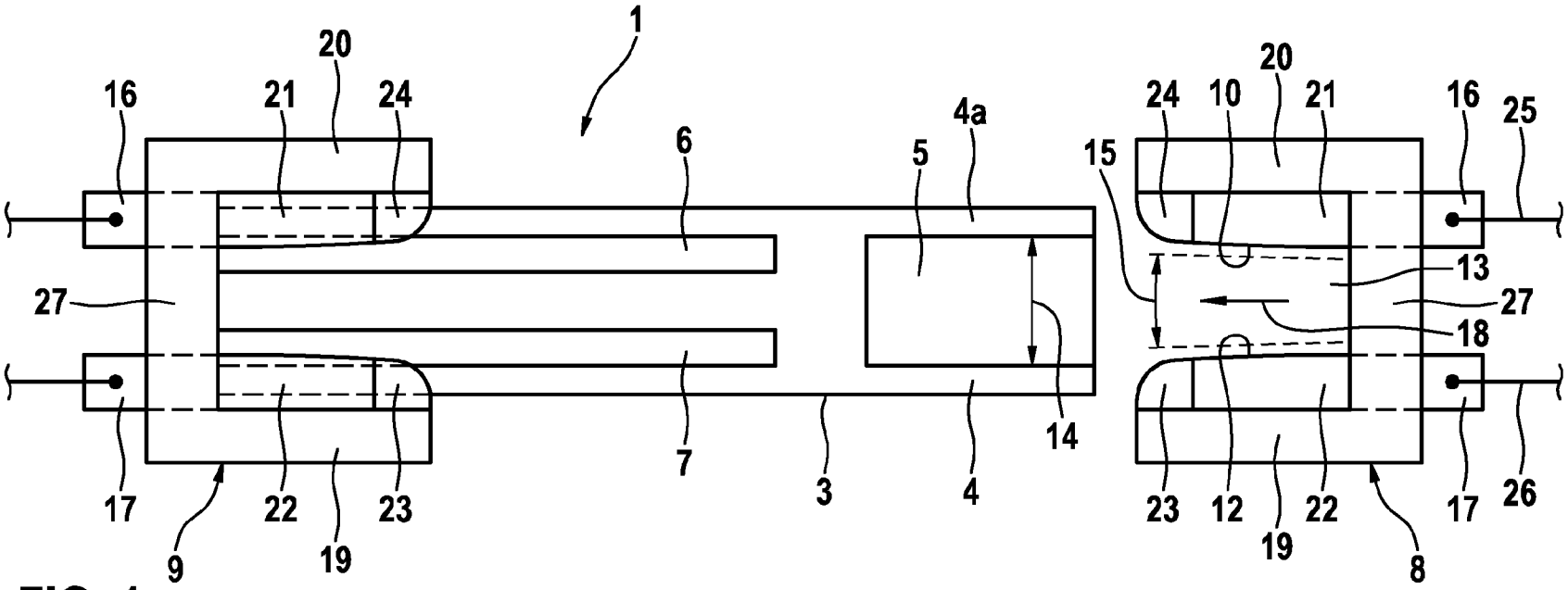
FIG. 1 shows an exemplary embodiment for a contact system comprising a multi-layered circuit board having an internal copper thick-layer and two contact elements which contact the copper thick-layers in a longitudinal cross section.

FIG. 1 shows—schematically—an exemplary embodiment for a contact system 1. The contact system 1 has a circuit board 3. The circuit board 3 comprises a substrate layer 4 and a substrate layer 4*a*, which are formed in each case by fiber-reinforced epoxy resin in this exemplary embodiment. The circuit board 1 also comprises three electrically conductive layers which lie in said circuit board 1, namely the electrically conductive layer 5, the electrically conductive layer 6 and the electrically conductive layer 7. The electrically conductive layers 6 and 7 extend parallel to one another and are spaced apart from one another and are insulated from one another by a further substrate layer. In this exemplary embodiment, the electrically conductive layer 5 has a thickness dimension which is three times as large as a thickness dimension of the substrate layers 4 and 4*a*, between which the electrically conductive layer 5 is enclosed—in a sandwich-like manner.

The contact system also comprises a contact element 8 and a contact element 9. The contact element 8 is U-shaped in this exemplary embodiment, the U-limbs forming in each case a clamping jaw 19 and a clamping jaw 20. The clamping jaws 19 and 20 jointly enclose an opening 13.

In this exemplary embodiment, the contact element 8 has a cutting blade which is connected to the clamping jaw 20 and forms the previously mentioned cutting edge. The cutting blade has a cutting edge 10 and comprises two materials which are different from each other along a longitudinal extension thereof, namely a harder material 24, in this embodiment steel, and a material 21 which is softer in comparison thereto, in this exemplary embodiment copper. The copper is formed in this exemplary embodiment by the previously mentioned copper alloy C18018. The contact section 21 extends through one connecting section 27 that connects the clamping jaws 19 and 20, wherein a terminal 16 is formed in the region of an end which protrudes from the connecting section 27. The terminal 16 is connected to an electrical connecting wire 25 in this exemplary embodiment.

The clamping jaw 19 has a cutting blade which has a severing section 23 and a contact section 22 along the longitudinal extension thereof. The severing section 23 is formed from steel in this exemplary embodiment; and the contact element 22 is formed from the previously mentioned copper alloy. The contact section 22 is, similarly to the contact section 21, guided through the connecting section 27 and protrudes with an end section out of the connecting section 27 and forms a contact 17 there. The contact 17 is connected to an electrical connecting cable 26.

If the contact element 8 is pushed along the direction of the arrow 18 onto an end section of the circuit board 3, the cutting edge 10 then cuts in the area of severing section 24 into the substrate layer 4*a*. If the contact element 8 is pushed further in the direction of the arrow 18 onto the end section of the circuit board 3, the cutting edge 10 then contacts the electrically conductive layer 5 on one side in the area of the contact section 21 and cuts in there. The cutting edge 12 has cut into the substrate layer 4 with the severing section 23 on the side opposite to that on which the cutting edge 10 has cut into the substrate layer 4*a* and said cutting edge 12 contacts the electrically conductive layer 5. When the contact element 8 is pushed further onto the end section of the circuit board 3, the contact section 22 contacts the electrically conductive layer 5 on the opposite side. The cutting edges 10 and 12 are spaced apart at a distance from one another in the area of the severing section 23 or, respectively, 24, the distance corresponding to the thickness dimension 14 of the electrically conductive layer 5. The cutting edges 10 and 12 are spaced apart at a distance from one another in the area of the contact section 21 or, respectively, 22, the distance being equal to or smaller than the thickness dimension of the electrically conductive layer 5. In this exemplary embodiment, the cutting edges 10 and 12 enclose an angle 15 between themselves, so that the opening 13 between the limbs in the area of the cutting edges 10 and 12 is designed to taper towards the connecting section that connects the clamping jaws 19 and 20. In this way, the cutting edges 10 and 12 can also cut into the electrically conductive layer and can be respectively cold welded to the same.

A contact element 9 is also depicted which is designed like the contact element 8. The elements of the contact element 9 having the same reference sign correspond in characteristic and function to those of the contact element 8 having the same reference sign. The contact element 9 has already been pushed onto an end section of the circuit board 3 which lies opposite the end section comprising the electrically conductive layer 5. The electrically conductive layer is thereby contacted by the severing section 23 and by the contact section 22. The electrical terminal 17 is therefore in electrical operative connection with the electrically conductive layer 7.

The severing section 24 has severed, in particular cut through or milled through, the substrate layer 4*a* which covers the electrically conductive layer 6 towards the outside; thus enabling the severing section 24 and the contact section 21 to contact the electrically conductive layer 6 by means of the cutting edge 10 in a plastically deforming manner. In so doing, a cold weld is formed, so that the contact section 21 is connected to the electrically conductive layer 6 by means of a particularly good and gastight electrically conductive connection. The electrical terminal 16 therefore contacts the electrically conductive layer 6 via the contact section 21 in the area of the incision or, respectively, in the area of the plastic deformation of the electrically conductive layer 6 by means of said contact section 21 and additionally in the area of the severing section 24.

Figure 2:
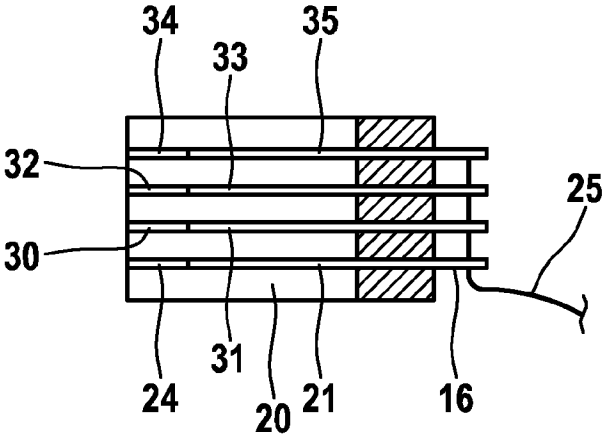
FIG. 2 shows the contact element depicted in FIG. 1 in a top view of the cutting blade.

FIG. 2 shows the clamping jaw 20, which has already been depicted in FIG. 1, in a top view of the opening 13 onto the cutting blade. In this exemplary embodiment, the clamping jaw 20 has four cutting blades, wherein the cutting blade already depicted in FIG. 1 comprises the severing section 24 in the area of the inlet of the opening 13 and the contact section 21 along a longitudinal direction of the cutting edge. A cutting blade which extends parallel to and spaced apart from the cutting blade comprising the severing section 24 and the contact section 21 comprises a severing section 30 and a contact section 31. A third cutting blade, which extends parallel to and spaced apart from the cutting blade comprising the contact section 31, comprises a severing section 31 and a contact section 33. A fourth cutting blade comprises a severing section 34 and a contact section 35. When pushing the contact element comprising the clamping jaw 20 onto the circuit board edge, the severing sections 24, 30, 32 and 34 consequently jointly cut into a substrate, in particular a substrate layer covering an electrically conductive layer, of a circuit board. When said contact element is pushed further along the longitudinal direction of the cutting edges, the contact sections 21, 31, 33 and 35 then cut jointly and pressingly into the electrically conductive layer which is disposed under the substrate layer and thus contact said electrically conductive layer in a plastically deforming manner and electrically by means of cold welding. The terminal 16 is also shown, which has previously been depicted and via which the contact element comprising the clamping jaw 20 can be contacted towards the outside. The terminal 16 can be electrically connected to corresponding terminals of the contact sections 31, 33, and 35. The connecting cable 25 is therefore in electrical operative connection with the contact sections 21, 31, 33 and 35.

Figure 3:
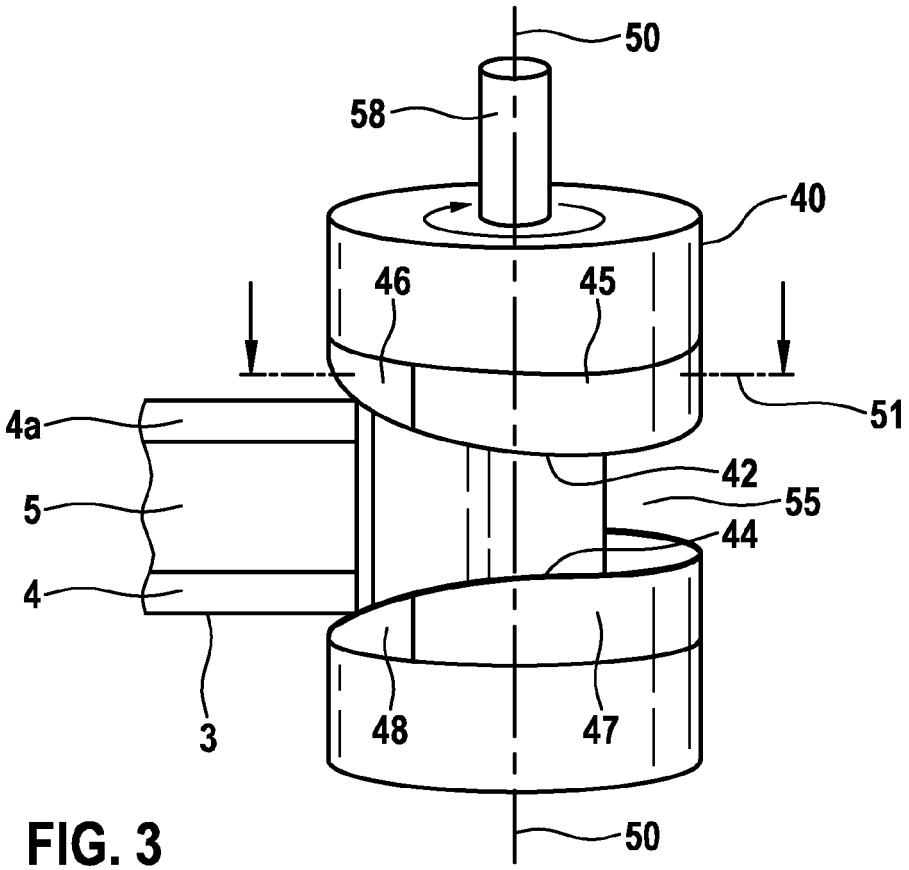
FIG. 3 shows a cylindrically designed contact element which can be turned onto a circuit board edge.

FIG. 3 shows an embodiment for a contact element which can contact an end section of a circuit board on the basis of the same operating principle as the contact element 8 described above; however, not by means of a translatory motion but by means of a rotational motion about a rotational axis 50. To this end, the contact element is designed cylindrically and has two cutting edges 44 and 42 that are spaced apart from one another and enclose an opening 55 between one another. The cutting edges 42 and 44 are each spaced apart in a radially circumferential manner about the rotational axis 50 which also forms a cylinder vertical axis of the contact element 40 in this exemplary embodiment. The cutting edge 42 is a constituent part of a cutting blade which comprises a severing section 46 in the area of an inlet region of the opening 55 and a contact section 45 further along a longitudinal extension of the cutting edge 42. The severing section 46 is formed from steel in this exemplary embodiment and the contact section 45 from copper. The cutting edge 44 is a constituent part of a further cutting blade, comprising the severing section 48 and the contact section 47, the severing section 48 being formed from steel and the contact section 47 from copper.

If the contact element 40 comprising the opening 55 is placed in the area of the severing sections 46 and 48 onto an edge of an end section of the circuit board 3, the circuit board end section can thus be inserted into the opening 55 by means of a rotational movement of the contact element 40 about the rotational axis 50. The severing section 46 cuts thereby into the substrate layer 4*a*, and the severing section 48 into the substrate layer 4. The electrically conductive layer 5 is—in a sandwich-like manner—enclosed between the substrate layers 4 and 4*a*. If the contact element 40 is further rotated about the rotational axis 50, the cutting edge 42 can then follow the cutting track which has been carved out in the substrate layer 4*a* by means of the severing section 46 and, while moving in said cutting track of said substrate layer 4*a*, contact the electrically conductive layer 5 and pressingly cut into the same. To this end, the cutting edges 42 and 44 run together towards one end of the opening 55, so that the opening 55 is formed so as to be tapered towards the end.

Figure 4:
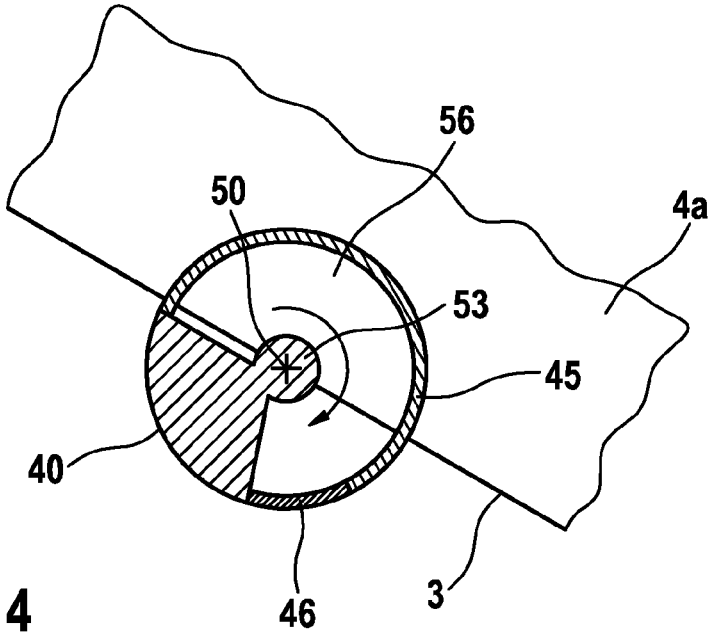
FIG. 4 shows the contact element depicted in FIG. 3 in a sectional view.

FIG. 4 shows the contact element 40 depicted in FIG. 3 in a sectional view along the section 51 depicted in FIG. 3. The sectional plane of the sectional view depicted in FIG. 4 runs perpendicularly to the rotational axis 50.

The contact element 40 comprises a center column 53 which—like in FIG. 3—opens out into a terminal 58. The contact element 40 can thus be connected by means of the terminal 58 to an electrical connecting cable—for example via a plug connection. The contact element 40 is—as depicted in FIG. 4—designed partially hollow and thus has a hollow space 56 to meet this end, in which the end section of the circuit board 3 can be received when turning the contact element 40 onto the circuit board edge. The cutting edge 42 has thereby cut through the substrate layer 4*a* into the electrically conductive layer 5.

Figure 5:
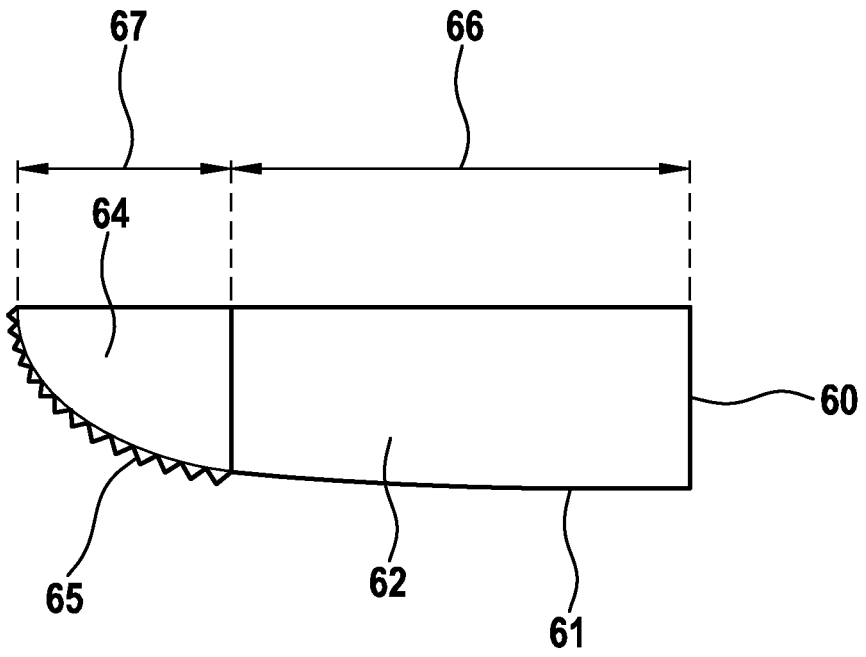
FIG. 5 shows a variant for a cutting blade comprising a cutting edge which has teeth in the severing section thereof.

FIG. 5 shows a variant for a cutting blade, comprising a longitudinal section 67 in which the severing section 64 is formed. The cutting edge 61 has teeth 65 in the area of the severing section 64. The cutting edge 61 can easily cut through fibers, in particular glass fibers of an epoxy resin substrate layer, using the teeth 65. In this exemplary embodiment, the teeth 65 are formed from hardened steel and are designed to cut through a substrate layer comprising epoxy resin and glass fibers. The cutting blade 60 comprises a contact section 62 in the area of a longitudinal section 66. The contact section 62 is made of copper, in particular a copper alloy, for example an alloy formed in accordance with the US standard C18018 or the standard UNS C-19010. The cutting blade 60 can be formed as a cutting blade on the contact element 8 depicted in FIG. 1 and/or on the contact element 40 depicted in FIG. 3.

What is claimed is:

1. A contact element (8, 9, 40) for connecting to a circuit board (3) having at least one substrate layer (4, 4*a*) and having at least one electrically conductive layer (5, 6, 7) which is connected to the substrate layer (4, 4*a*), the contact element (8, 9, 40) being configured to connect to the electrically conductive layer (5, 6, 7), characterized in that the contact element (8, 9, 40) is configured to be pushed onto a circuit board edge of the circuit board (3) and to reach over the circuit board edge, wherein the contact element (8, 9, 40) has at least one cutting blade with a cutting edge (10, 12, 42, 44, 61), the cutting edge (10, 12, 42, 44, 61) having a harder metal in an area of a severing section (23, 24, 46, 48, 67) than in an adjoining contact section (21, 22, 44, 45, 62) alongside the cutting edge (10, 12, 42, 44, 61), and said cutting edge (10, 12, 42, 44, 61) being configured to cut through the substrate layer (4, 4*a*) with the severing section (23, 24, 46, 48, 67) when pushed onto the circuit board edge and to contact the electrically conductive layer (5, 6, 7) electrically with the contact section (21, 22, 44, 45, 62).

2. The contact element (8, 9, 40) according to claim 1, characterized in that the contact element (8, 9, 40) has at least two cutting edges (10, 12, 42, 44, 61) and is configured to reach over the circuit board edge and to contact the at least one electrically conductive layer (8, 9, 40) from two sides by means of the cutting edges (10, 12, 42, 44, 61).

3. The contact element (8, 9, 40) according to claim 1, characterized in that the contact element (8, 9, 40) has an opening (13, 55) which taper towards one end and extends longitudinally, the cutting edge (10, 12, 42, 44, 61) forming an opening edge of the opening (13, 55).

4. The contact element (8, 9, 40) according to claim 1, characterized in that the contact element (8, 9, 40) is U-shaped and has U-limbs configured as a clamping jaw (19, 20).

5. The contact element (8, 9, 40) according to claim 1, characterized in that the at least one cutting edge (10, 12, 42, 44, 61) runs circumferentially about a rotational axis (50) so as to be spaced apart radially from said axis and the contact element (40) is configured to cut into the circuit board edge by being moved rotationally about the rotational axis (50).

6. The contact element (8, 9, 40) according claim 1, characterized in that the cutting edge (10, 12, 42, 44, 61) is configured in the severing section to cut through fibers integrated into the substrate layer (4) when pushed onto the circuit board edge.

7. A contact system (1) having at least one contact element (8, 9, 40) according to claim 1, comprising a circuit board (3) having the at least one substrate layer (4, 4*a*) and having the at least one electrically conductive layer (5, 6, 7), wherein a material of the cutting blade is harder in an area of the contact section (21, 22, 42, 44, 62) than a material of the electrically conductive layer (5, 6, 7).

8. The contact system (1) according to claim 7, characterized in that the substrate layer (4, 4*a*) to be severed by the cutting edge (22, 24) has a thickness of at least one tenth of a thickness of the circuit board (3).

9. A method for connecting a circuit board (3) to a contact element (8, 9, 40), the method comprising:

providing the circuit board (3) having a circuit board edge, wherein the circuit board (3) has at least one electrically conductive layer (5, 6, 7) and at least one electrically insulating substrate layer (4, 4*a*) connected to the electrically conductive layer (5, 6, 7);

providing the contact element (8, 9, 40), wherein the contact element (8, 9, 40) has at least one cutting blade with a cutting edge (10, 12, 42, 44, 61), the cutting edge (10, 12, 42, 44, 61) having a harder metal in an area of a severing section (23, 24, 46, 48, 67) than in an adjoining contact section (21, 22, 44, 45, 62) alongside the cutting edge (10, 12, 42, 44, 61);

severing the substrate layer (4, 4*a*) with the cutting edge (10, 12, 42, 44, 61) when the contact element (8, 9, 40) is pushed onto the circuit board edge; and electrically contacting the electrically conductive layer (5, 6, 7), in the area of the severed substrate layer (4, 4*a*), when the contact element (8, 9, 40) is pushed onto a circuit board edge of the circuit board (3).

10. The method according to claim 9, in which the substrate layer (4, 4*a*) comprises fibers and is severed together with the fibers.

11. The contact element (8, 9, 40) according to claim 1, wherein the substrate layer (4, 4*a*) is an electrically insulating substrate layer, and the electrically conductive layer is an internal, electrically conductive layer (5, 6, 7).

12. The contact element (8, 9, 40) according to claim 2, characterized in that the contact element (8, 9, 40) has an opening (13, 55) which taper towards one end and extends longitudinally, the cutting edge (10, 12, 42, 44, 61) forming an opening edge of the opening (13, 55).

13. The contact element (8, 9, 40) according to claim 12, characterized in that the contact element (8, 9, 40) is U-shaped and has U-limbs configured as a clamping jaw (19, 20).

14. The contact element (8, 9, 40) according to claim 13, characterized in that the at least one cutting edge (10, 12, 42, 44, 61) runs circumferentially about a rotational axis (50) so as to be spaced apart radially from said axis and the contact element (40) is configured to cut into the circuit board edge by being moved rotationally about the rotational axis (50).

15. The contact element (8, 9, 40) according claim 14, characterized in that the cutting edge (10, 12, 42, 44, 61) is configured in the severing section to cut through fibers integrated into the substrate layer (4) when pushed onto the circuit board edge.

16. The contact element (8, 9, 40) according to claim 1, wherein the contact element (8, 9, 40) is configured to generate a cold weld between the contact section (21, 22, 44, 45, 62) of the cutting edge (10, 12, 42, 44, 61) and the electrically conductive layer (5, 6, 7) in the area of the circuit board edge when pushed onto or turned onto said circuit board edge.

17. The contact element (8, 9, 40) according to claim 4, wherein the cutting edge (61) has teeth (65) in the area of the separating section (23, 24, 46, 48, 67), wherein the cutting edge (61) is configured to cut fibers of the substrate layer (4,

4*a*) with the teeth (65), and wherein the substrate layer (4, 4*a*) is an epoxy resin substrate layer.

18. The contact system (1) according to claim 7, wherein the contact element (8, 9, 40) is U-shaped and has U-limbs configured as a clamping jaw (19, 20).

* * * * *